US011587536B2

(12) United States Patent
Conrad et al.

(10) Patent No.: US 11,587,536 B2
(45) Date of Patent: Feb. 21, 2023

(54) APPARATUS FOR ATTACHING A STRAP TO A GUITAR OR BASS GUITAR

(71) Applicants: Peter Roland Conrad, Northwood, NH (US); Erika Katherine Conrad, Northwood, NH (US)

(72) Inventors: Peter Roland Conrad, Northwood, NH (US); Erika Katherine Conrad, Northwood, NH (US)

( * ) Notice: Subject to any disclaimer, the term of this patent is extended or adjusted under 35 U.S.C. 154(b) by 25 days.

(21) Appl. No.: 17/367,370

(22) Filed: Jul. 4, 2021

(65) Prior Publication Data

US 2022/0157277 A1 May 19, 2022

Related U.S. Application Data

(60) Provisional application No. 63/114,802, filed on Nov. 17, 2020.

(51) Int. Cl.
*G10D 1/08* (2006.01)
*G10G 5/00* (2006.01)

(52) U.S. Cl.
CPC ..... *G10D 1/08* (2013.01); *G10G 5/005* (2013.01)

(58) Field of Classification Search
CPC ..... G10D 1/08; G10D 1/085; G10G 5/005
See application file for complete search history.

(56) References Cited

U.S. PATENT DOCUMENTS 3,251,258 A * 5/1966 Parker ..... G10D 1/085 984/107

* cited by examiner

*Primary Examiner* — Kimberly R Lockett

(57) ABSTRACT

The present invention is an apparatus used to connect a typical guitar strap in non-traditional positions on the body of a guitar or bass guitar, which affixes to the instrument to provide stability and balance. The core components of the apparatus are a resilient hollow plastic outer shell with an external protrusion extending from the apex, a protective non-slip thermoplastic rubber inner layer, and metal hardware, suitable for use with virtually all guitar straps presently in use, attached to the external protrusion. The invention can be used to attach a strap to a guitar or bass guitar securely, without damaging the finish or affecting the tonal integrity of the instrument. Furthermore, it should be noted that the apparatus is generally a parabolic shape, intended to securely fit over the upper or lower horn of a guitar or bass guitar.

1 Claim, 4 Drawing Sheets

APPARATUS FOR ATTACHING A STRAP TO A GUITAR OR BASS GUITAR

BACKGROUND

1. Field of the Invention

The invention relates generally to an apparatus for attaching a strap to a guitar or bass guitar.

2. Background

Currently, there are a number of solutions to address neck dive in guitars and bass guitars. Some of these solutions attempt to rebalance or stabilize the instrument, but they fail to meet the needs of the industry: some require drilling additional holes into the body of the instrument to relocate a guitar strap connector button, potentially damaging the finish and tonal integrity of the guitar or bass guitar; some are used to anchor a strap that is then attached to the player's body, restricting freedom of movement. Other solutions attempt to add weight to a typical guitar strap to better balance the instrument, but these solutions are similarly unable to meet the needs of the industry because adding weight to a guitar or bass guitar causes stress and fatigue in the player's shoulders and arms, making the instrument more difficult to play.

SUMMARY OF THE INVENTION

The present invention addresses two problems that can be found with guitars and bass guitars. The first is that of "neck dive": in many guitars and bass guitars, the neck of the instrument is heavier than the body of the instrument, shifting the center of gravity and causing the neck to tilt downward and the body of the instrument to tilt away from the player, which results in a loss of control over the instrument.

The second problem the present invention addresses is that typically, when a left-handed person plays a right-handed instrument, or vice versa, when a right-handed person plays a left-handed instrument, the instrument is turned upside down, such that the neck of the instrument is in the player's dominant hand. In this upside-down position, attaching the guitar strap to the body of the instrument using the traditionally-placed guitar strap connector buttons impedes the ability to play the instrument because the strap hampers access to the upper frets on the neck.

Disclosed is an apparatus for attaching a typical guitar strap to a guitar or bass guitar in a non-traditional position on the body of the instrument, which is made up of the following components: resilient hollow plastic outer shell, a protective non-slip thermoplastic rubber inner layer, fasteners, and a button for attaching a typical guitar strap. These components are related as follows: a resilient hollow plastic outer shell in the shape of the uppermost part of the body of a guitar or bass guitar ("horn") comprising at least four sides, with a rounded or tapered top, an external protrusion extending from the apex of the outer shell, and an open underside exposing a hollow inner cavity; a protective non-slip inner layer lining the cavity; fasteners comprising a well nut inserted into the hole in the external protrusion extending from the apex of the outer shell; a ferrule and strap connector button, placed on the outside of the outer shell, aligned with the hole in the external protrusion extending from the apex of the outer shell, with a screw inserted externally through the strap connector button, ferrule and into the well nut to secure the strap connector button. The apparatus is secured with manual pressure to the horn of the guitar or bass guitar, and a guitar strap is attached to the apparatus.

The apparatus may be manufactured to fit any desired shape, size, color, and design so as to be compatible with a wide variety of guitars and bass guitars, and other shapes, sizes, colors, and designs of the apparatus are comprised of the same components, and the external protrusion extending from the apex of the apparatus may be placed in other positions on the apparatus, with the same fastener and button components as described, for specific models of guitars or bass guitars where placement will more effectively balance the instrument.

In one embodiment of the apparatus, a thermoplastic rubber inner layer may be substituted by a thin layer of non-slip foam; in this embodiment, a non-residual dry adhesive may be used to secure the apparatus to the horn of the guitar or bass guitar.

It should be noted that elements of the fasteners of the apparatus may be manufactured to comprise one single piece consisting of the ferrule and guitar strap connector button, with the well nut and screw remaining separate, individual pieces.

It should be further noted that in some embodiments, the well nut may be replaced with a threaded insert.

The disclosed apparatus is unique because it improves the balance and stability of a guitar or bass guitar without damaging the body of the instrument or the tonal integrity of the instrument, without adding discernable weight to the instrument, and without restricting movement of the player's body. By lengthening the distance between the body of the guitar or bass guitar and the guitar strap connection point and relocating the position of the guitar strap connector button, the center of gravity shifts further away from the body of the guitar or bass guitar and more toward the neck of the guitar or bass guitar, enabling stability for both the instance of a neck-heavy instrument and the instance of playing a guitar or bass guitar in an upside-down position. With manual pressure, the apparatus affixes securely and non-permanently to a guitar or bass guitar, and is removed by applying reverse pressure.

The disclosed apparatus is unique in that it is structurally different from other known devices or solutions because it provides a guitar strap connector button for guitars and bass guitars: (1) which affixes to the guitar or bass guitar securely, without damaging the finish or tonal integrity of the instrument; that (2) shifts the center of gravity of the instrument by extending and moving the position of the guitar strap connector button; that (3) provides open access to all frets on the neck of the guitar or bass guitar, without impediment from the guitar strap; and (4) provides improved stability, balance, and control of the guitar or bass guitar.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The Apparatus for attaching a strap to a guitar or bass guitar may, however, be embodied in many different forms and should not be construed as being limited to the embodiments set forth herein; rather, these embodiments are provided by way of illustration only and so that this disclosure will be thorough, complete and fully convey understanding to those skilled in the art.

DETAILED DESCRIPTION

The present invention is directed to an apparatus for attaching a strap to a guitar or bass guitar In its most complete version, the apparatus is made up of the following components: (1) a resilient hollow plastic outer shell in the shape of the horn of a guitar or bass guitar comprising at least four sides, with a curved or tapered apex and an open underside exposing a hollow interior cavity, of at least two to four millimeters in thickness, at least two to four inches in height and at least one to two inches in width, having four sides: a right side and a left side, with the right and left sides being substantially identical and parallel to each other, a front side and a back side, with the back side curving and tapering, and being slightly longer than the front side, and the front side slightly curving inward and then outward, an external protrusion extending from the apex measuring approximately one-half inch in diameter and at least four millimeters in height and with a hole in the center of the protrusion; (2) a protective non-slip thermoplastic rubber material of one half millimeter to two millimeters thick, that is secured into the cavity such that it is bonded to the interior of the resilient hollow plastic outer shell on all sides; (3) fasteners, consisting of a well nut, a ferrule, a strap connector button placed on the ferrule, and a screw, all aligned with the hole in the center of the external protrusion extending from the apex, with the screw inserted into the strap connector button, through the ferrule, and tightened into threaded insert or well nut to secure the guitar strap connector button to the apparatus. Once assembled, the apparatus slips on to the guitar or bass guitar, where it is secured with manual pressure, and a typical guitar strap is attached to the guitar strap connector button that is part of the apparatus.

Figure 1:
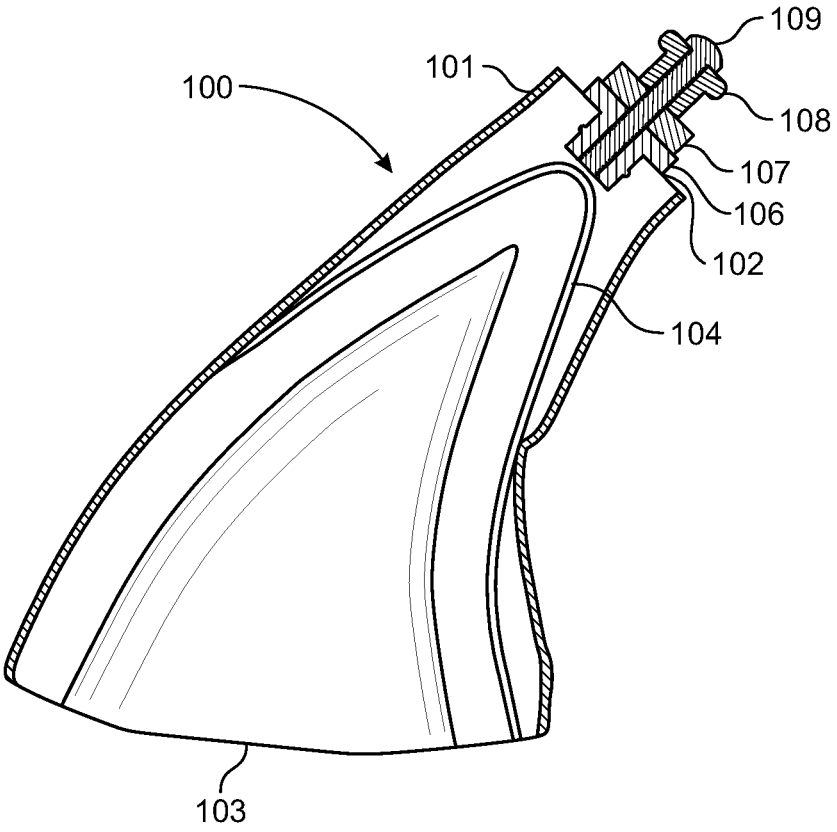
FIG. 1 is a diagram illustrating a cross-section view of the outer and inner layers and fasteners of an apparatus for attaching a strap to a guitar or bass guitar in a non-traditional position on the body of the instrument in accordance with an exemplary embodiment.

Shown in FIG. 1 is a diagram illustrating a side sectional view of an apparatus for attaching a strap to a guitar or bass guitar in a non-traditional position on the body of the instrument in accordance with one exemplary embodiment. As shown, the apparatus includes a resilient hollow plastic outer shell in the shape of the horn of a guitar or bass guitar 100 with an external protrusion extending from the apex measuring approximately one-half inch in diameter and at least four millimeters in height 101 with a hole in the center of the protrusion 102 and with an open underside exposing a hollow inner cavity 103, lined with a protective non-slip thermoplastic rubber material affixed to the entirety of the inner cavity 104, with a well nut 106 inserted into the hole 102 in the center of the external protrusion extending from the apex 101, with a ferrule 107 placed on top of the well nut 106 and a strap connector button 108 placed on top of the ferrule 107, with a screw 109 inserted into the guitar strap connector button 108 and through the ferrule 107 and tightened into the well nut 106.

By way of example, the resilient hollow plastic outer shell of the apparatus 100 may be substantially parabolic in shape. In one particular and illustrative, yet non limiting, embodiment of the outer shell 100, it may at its widest section have a width of approximately one to two inches and at its tallest section a height of approximately two to four inches. These measurements are merely illustrative and apparatus of any width and any length that include the features described herein are intended to be within this disclosure and make up the overall invention, which has many different embodiments.

It is noted that the outer shell of the apparatus 100 may alternatively be shaped with a more pointed or more rounded top than depicted herein, the shape being selected based on the model and design of the guitar or bass guitar to which the apparatus (FIG. 1) will be affixed. It is further noted that the screw 109 may vary in length, the length being selected based on the model and design of the guitar or bass guitar to which the apparatus (FIG. 1) will be affixed, along with additional ferrules, such that it is of sufficient length to remediate any imbalance in the guitar or bass guitar resulting from a heavy neck.

Figure 2:
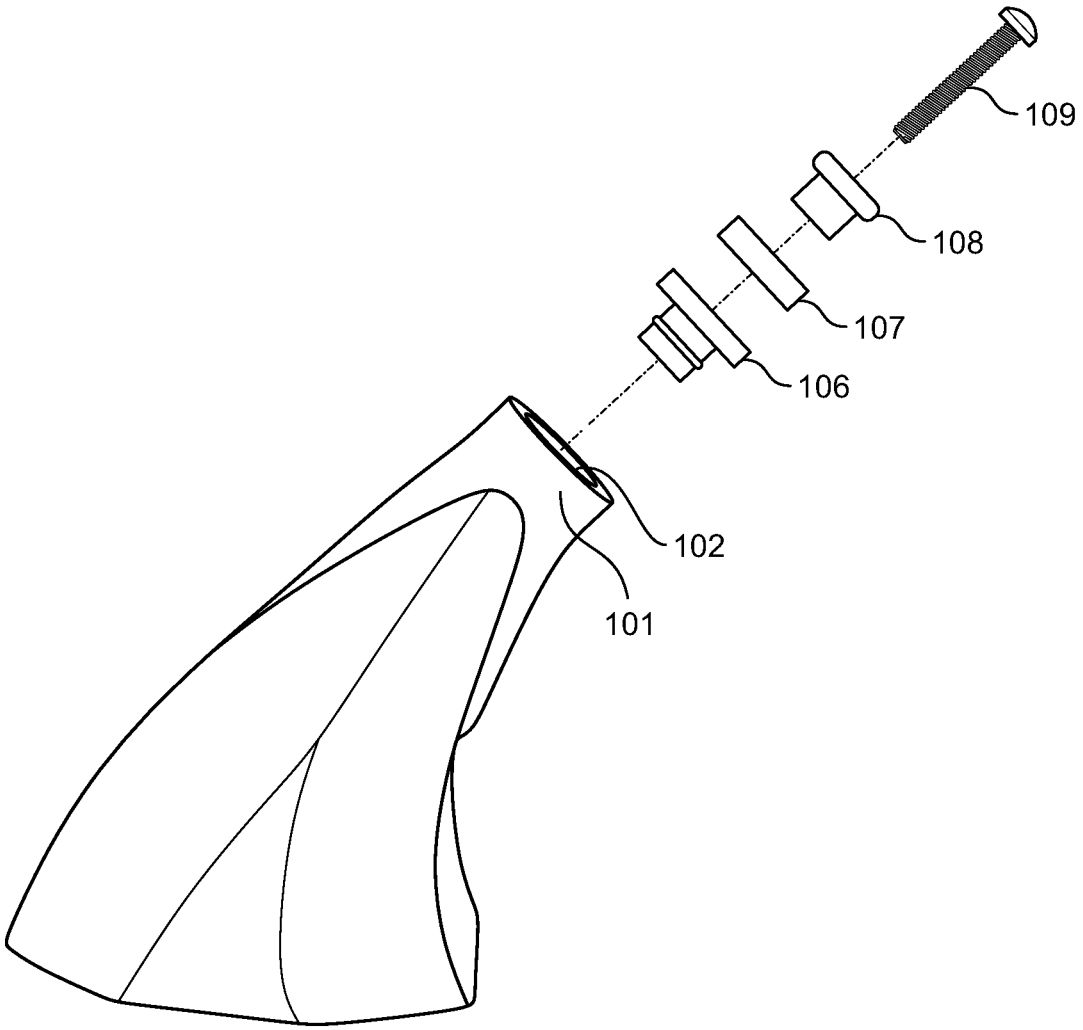
FIG. 2 is a side view of the apparatus in accordance with an exemplary embodiment.

Shown in FIG. 2 is a side view of the invention, showing the resilient hollow plastic outer shell 100, external protrusion extending from the apex 101, with an exploded view of the well nut 106, ferrule 107, strap connector button 108 and screw 109 to be inserted through the hole in the center of the external protrusion extending from the apex 102.

Figure 3:
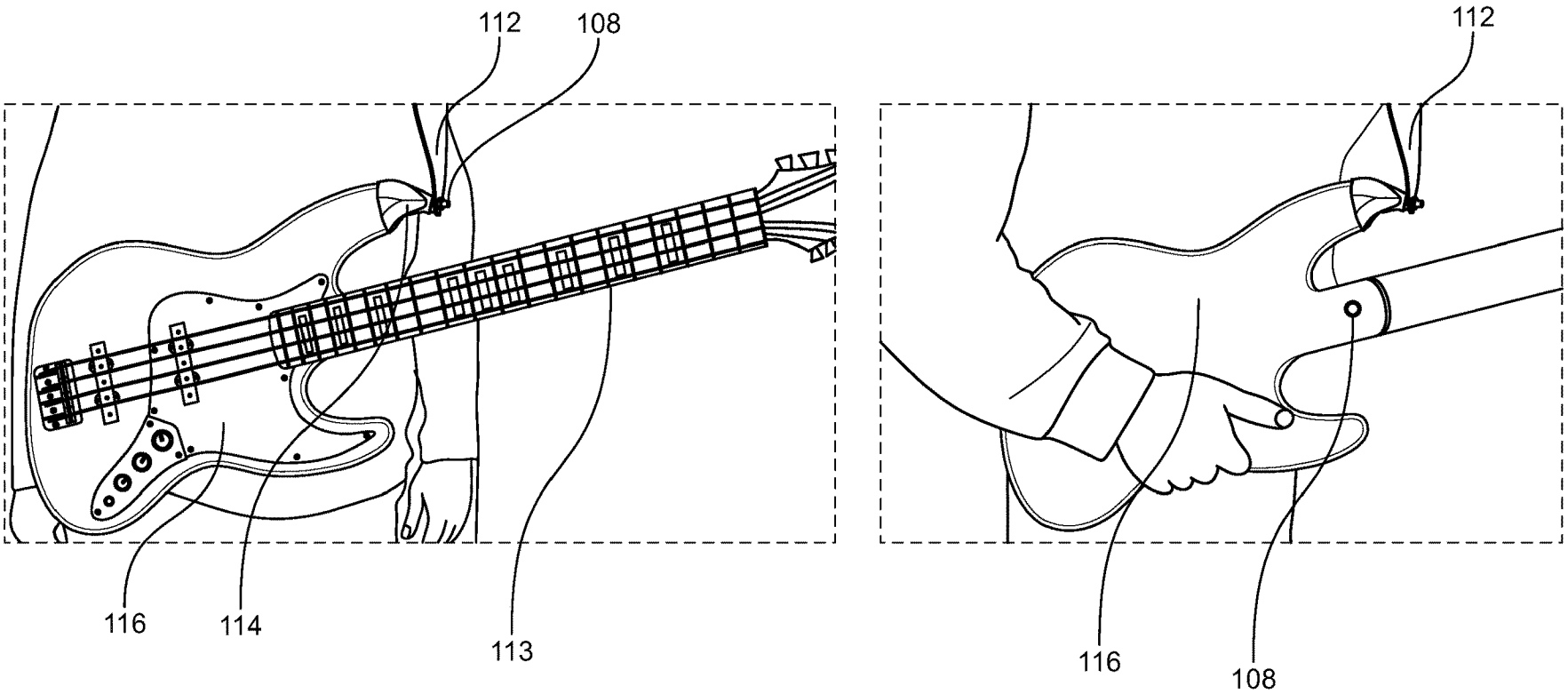
FIG. 3 is a perspective view of the apparatus affixed to the lower horn of a bass guitar, and a guitar strap affixed to the apparatus, in accordance with an exemplary embodiment.

Shown in FIG. 3 is a front view illustration of a guitar 116, with the apparatus affixed to the upper horn 114, with a standard guitar strap 112 attached to the strap button 108 on the apparatus, such that the center of gravity of the guitar extends further toward the neck 113, thus balancing the guitar and remediating neck dive.

Of note is the traditionally-placed strap connector button 108 positioned on the back side of the guitar 116, which, when used with a standard guitar strap 112, can unbalance the guitar, resulting in neck dive and a loss of control of the instrument.

Figure 4:
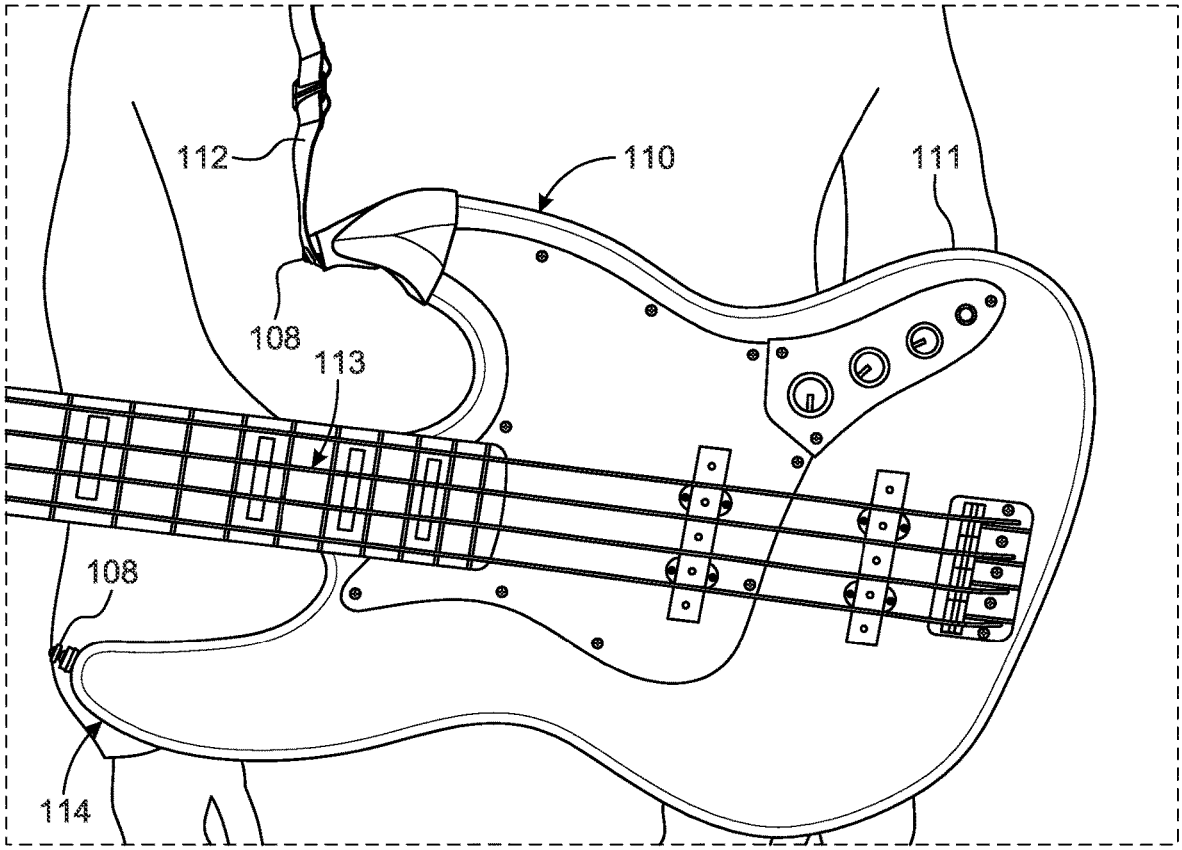
FIG. 4 is a perspective view of the apparatus affixed to the upper horn of a bass guitar, and a guitar strap affixed to the apparatus, in accordance with an exemplary embodiment.

Shown in FIG. 4 is a front view illustration of a right-handed bass guitar, with another embodiment of the apparatus affixed to the lower horn 110 of the body of the bass guitar 111, with a standard guitar strap 112 attached to the strap button 108 on the apparatus, thus enabling a left-handed person to play the right-handed bass guitar in an upside-down position with no impediment to the neck 113 of the bass guitar.

Of note is the traditionally-placed strap button 108 on the upper horn 114 of the right-handed bass guitar, which, when attached to a standard guitar strap 112, impedes access to the neck 113 for a left-handed person playing a right-handed bass guitar in an upside-down position, as shown.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

The invention claimed is:

1. An apparatus for balancing a guitar or bass guitar comprising: a resilient plastic outer shell with a hollow cavity, wherein said resilient plastic outer shell is entirely in the shape of an upper horn of a guitar or bass guitar; a protrusion extending from an apex of said resilient plastic outer shell; a guitar strap connector button secured with a fastener to said protrusion of said resilient plastic outer shell; and a protective non-slip inner layer secured to the hollow cavity of said resilient plastic outer shell.

* * * * *